United States Patent [19]

Moore, III

[11] 4,095,527

[45] Jun. 20, 1978

[54] SPECIALIZED DETONATOR FIRING CIRCUIT

[75] Inventor: Morrison Bert Moore, III, Silver Spring, Md.

[73] Assignee: The United States of America as represented by the Secretary of the Navy, Washington, D.C.

[21] Appl. No.: 396,782

[22] Filed: Sep. 15, 1964

[51] Int. Cl.[2] ..... F42C 11/06; F42C 9/00

[52] U.S. Cl. ..... 102/19.2; 102/206

[58] Field of Search ..... 102/70.2, 70.2 P, 19.2; 307/88.5 (15.2)

[56] References Cited

U.S. PATENT DOCUMENTS

| | | | |
|---|---|---|---|
| 2,942,548 | 6/1960 | Bushong | 102/70.2 P |
| 3,018,432 | 1/1962 | Palmer | 102/70.2 R |
| 3,137,811 | 6/1964 | Kirk | 102/70.2 R |
| 3,225,695 | 12/1965 | Kapp et al. | 102/70.2 R |

*Primary Examiner*—Charles T. Jordan

EXEMPLARY CLAIM

1. A condition responsive electronic firing circuit responsive to a predetermined change in supply voltage comprising:

a first switch means normally biased for conduction, a second switch means including a controlled rectifier normally biased for non-conduction, wherein the gate electrode is responsively connected to said first switch means whereby a change in the conductive state of said first switch effects a corresponding change in the conductive state of said second switch;

a detonator connected between one of the output electrodes of the controlled rectifier and a source of power whereby a detonating current passes therethrough when the rectifier becomes conductive;

a bypass capacitor connected between the gate and the other rectifier output electrode for preventing inadverent actuation of the rectifier by spurious signals;

a zener diode interconnecting said first switch means and a source of power;

a storage means connected across the output electrodes of said controlled rectifier to provide a discharge pulse to said detonator upon the initiation of conduction in said controlled rectifier.

3 Claims, 1 Drawing Figure

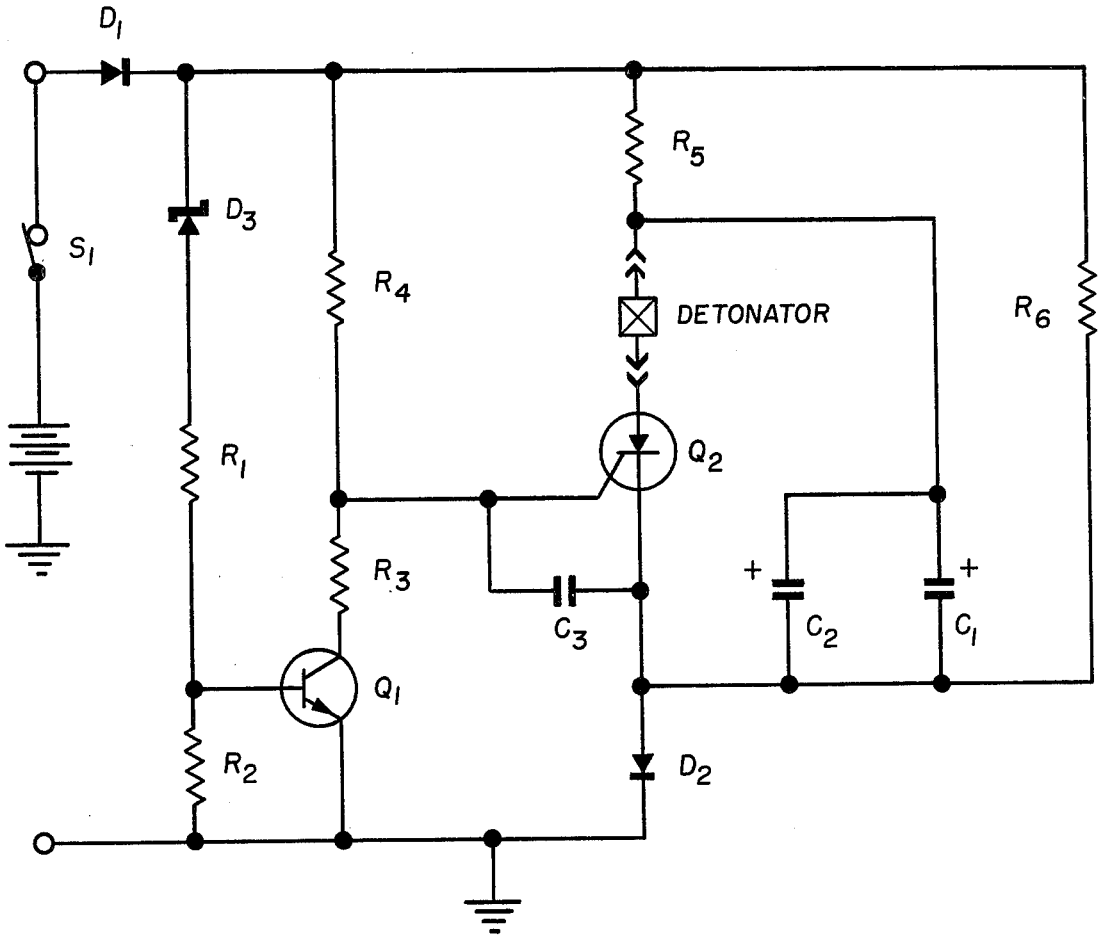
D1
S1
D3
R1
R2
R4
R3
Q1
R5
DETONATOR
Q2
C3
D2
C2
C1
R6
+
+

SPECIALIZED DETONATOR FIRING CIRCUIT

The invention described herein may be manufactured and used by or for the Government of the United States of America for governmental purposes without the payment of any royalties thereon or therefor.

The present invention relates generally to condition responsive electronic firing circuits and more particularly to an electronic circuit responsive to a predetermined change in supply voltage for producing a pulse of firing energy for firing a detonator.

The present invention has particular application in the sterilization of mines which, in the past, has been carried out by mechanisms of a mechanical or electrochemical nature. These devices normally operate on a time basis and the mine may or may not be still active when the sterilization takes place. An active mine life equal to the life of the battery power supply associated therewith is usually desirable. Since precise battery life is impossible to predict under the wide range of operating conditions encountered, some means of sensing battery voltage continuously is necessary. The present invention is designed to accomplish this function by providing a means for sterilizing a mine at the end of the power supply life.

While the circuit of the present invention has particular application as a means for continuously sensing the battery voltage until it falls to a predetermined threshold level, the invention could nevertheless have application in situations where the supply voltage is manually controlled.

Accordingly, an object of the present invention is to provide a reliable electronic firing circuit which will insure detonator and mine firing upon the application of a predetermined threshold voltage thereto.

Another object is to provide a novel electronic circuit operable to fire a detonator when the power supply associated therewith falls to a value below which is insufficient to fire the detonator.

Other objects and features of the present invention will become more fully apparent in the following description in the sole embodiment thereof.

Referring to the drawing there is shown a first normally conducting switch means Q1 coupled to the power supply through the Zener diode D3. A second switch means Q2 which is normally nonconducting is connected to the output of the first switch means Q1 and has a pair of storage means C1, C2 connected thereacross. When the second switch means Q2 is biased into conduction as switch means Q1 is cut off, capacitors C1 and C2 are allowed to discharge through the detonator to provide the necessary firing energy for mine sterilization.

Referring to the drawing in somewhat more detail there is shown a controlled rectifier Q2 which is biased in the off position by resistors R3, R4, R5 and R6. A capacitor C3 is connected between the gate electrode and output electrode of control rectifier Q2 to provide a by-pass path for the rectifier to prevent actuation thereof by spurious signals.

The capacitors C1 and C2 are connected in parallel and each have one plate connected to one side of the detonator and the other plate connected to the output electrode of controlled rectifier Q2. Capacitors C1 and C2 will charge with the polarity as shown when switch S1 is closed and the 12 volts is applied thereto. This causes no adverse effect on controlled rectifier Q2 and the associated detonator so long as Q1 is conducting. Q1 is a silicon transistor and is biased normally conducting by Zener diode D3 and resistors R1 and R2. The base of Q1 is biased through the Zener diode, D3, and provides a precise voltage drop thereacross sufficient to bias Q1 cutoff once the supply voltage falls to a desired threshold value.

In normal operation, the 12-volt power supply is connected to the circuit through switch S1 and diode D1. Transistor Q1 immediately becomes conducting as previously described, and capacitors C1 and C2 charge to approximately the supply voltage through R5. Once capacitors C1 and C2 have charged to the supply voltage, the circuit is armed for firing. If the supply voltage is removed, becomes shorted out, or falls to a predetermined value, Q1 ceases to conduct, allowing the voltage at the midpoint of resistors R3 and R4 to become approximately equal to the supply voltage. This turns on Q2 and C1 and C2 then discharge through the detonator and through Q2.

As the battery supply begins to fail, its voltage level decreases. D3, however, provides a constant voltage drop thereacross and this enables Q1 to become cut off when the supply voltage becomes equal to the Zener voltage of D3. For this reason D3 should be selected so that sufficient energy remains in capacitors C1 and C2 to fire the detonator as the battery supply voltage drops.

The following is a table of values for the circuit parameters shown in the drawing. These were used in the design of one circuit connected as shown in the drawing and are in no way intended to limit the scope of the present invention.

| Circuit Parameter | Value |
|---|---|
| R1 | 15K |
| R2 | 270K |
| R3 | 1K |
| R4 | 33K |
| R5 | 10K |
| R6 | 68K |
| C1 | 100 ufd |
| C2 | 100 ufd |
| C3 | .033 ufd |

The present invention provides a compact, reliable detonator firing circuit which incorporates a means for sterilizing a mine when its useful life has been expended. Furthermore it affords a means for sterilization in the event of mooring line failure. It does so without the use of at least three separate mechanisms which are now required to perform sterilization and flooding functions. Standard electronic components are used throughout in the design of the new and novel circuit described above.

The circuit of the present invention has a very low current drain which is in the vicinity of 0.67 milliamperes and this factor contributes to a long battery life. It is, however, possible to operate the present invention with much less current drain without degrading the performance thereof.

Although the circuit described is intended to fire a detonator, it may have a wide variety of applications anywhere a pulse of energy is utilized to perform some function in response to a given condition. The circuit shown may be readily redesigned to operate from nearly any practical power supply voltage without loss of the novel features described herein.

Accordingly it should be understood that the foregoing is only a description of an illustrative embodiment of the invention, the scope of which is limited only by the following appended claims.

I claim:

1. A condition responsive electronic firing circuit responsive to a predetermined change in supply voltage comprising:

a first switch means normally biased for conduction, a second switch means including a controlled rectifier normally biased for non-conduction, wherein the gate electrode is responsively connected to said first switch means whereby a change in the conductive state of said first switch effects a corresponding change in the conductive state of said second switch;

a detonator connected between one of the output electrodes of the controlled rectifier and a source of power whereby a detonating current passes therethrough when the rectifier becomes conductive;

a bypass capacitor connected between the gate and the other rectifier output electrode for preventing inadvertent actuation of the rectifier by spurious signals;

a zener diode interconnecting said first switch means and a source of power;

a storage means connected across the output electrodes of said controlled rectifier to provide a discharge pulse to said detonator upon the initiation of conduction in said controlled rectifier.

2. The circuit of claim 1 wherein said first switch means includes a transistor having its output electrode connected to the gate electrode of said controlled rectifier and its control electrode connected to said Zener diode whereby a rise in voltage at said gate electrode proportional to the rise in voltage of the output electrode of said transistor causes said controlled rectifier to become conducting.

3. The circuit of claim 2 wherein a source of supply voltage and said Zener diode are connected in parallel, said supply voltage being connected between the input and output electrodes of said transistor and said Zener diode being connected between said control and output electrodes whereby said Zener diode enables said transistor to be cut off and thereby turn on said controlled rectifier at a supply voltage level below which is insufficient to fire said detonator.

* * * * *